United States Patent [19]

Mitrofanov et al.

[11] Patent Number: 4,501,988

[45] Date of Patent: Feb. 26, 1985

[54] ETHYLENE QUENCHED MULTI-CATHODE GEIGER-MUELLER TUBE WITH SLEEVE-AND-SCREEN CATHODE

[75] Inventors: Nicholas M. Mitrofanov, Cleveland; Victor G. Berner, Mayfield Heights, both of Ohio

[73] Assignee: Harshaw/Filtrol Partnership, Cleveland, Ohio

[21] Appl. No.: 364,466

[22] Filed: Apr. 1, 1982

[51] Int. Cl.[3] ..... H01J 47/08

[52] U.S. Cl. ..... 313/93; 250/374; 445/28

[58] Field of Search ..... 313/93; 250/374; 445/28, 38, 40, 43, 53

[56] References Cited

U.S. PATENT DOCUMENTS

| | | | |
|---|---|---|---|
| 2,197,453 | 4/1940 | Hassler | 313/93 X |
| 2,519,864 | 8/1950 | Weisz | 313/93 X |
| 2,552,723 | 5/1951 | Koury | 313/93 |
| 2,606,296 | 8/1952 | Simpson, Jr. | 313/93 X |
| 2,715,195 | 8/1955 | Friedman | 313/93 |
| 3,338,653 | 8/1967 | Anton | 445/38 |

*Primary Examiner*—Palmer Demeo
*Assistant Examiner*—Sandra L. O'Shea
*Attorney, Agent, or Firm*—James A. Lucas

[57] ABSTRACT

A Geiger-Mueller ("GM") tube containing a noble gas mixture of about 98–99.9% Ne and the remainder Ar, and in addition containing from 2–5% ethylene as the quench gas, provides high stability and high count rates in the temperature range from about −100° C. to about 200° C. When this GM tube is provided with a sleeve-and-screen liner in electrical contact with an outer cathode, the tube exhibits exceptional sensitivity. The sleeve may be a continuous deposit of a heavy metal having an atomic number from about 73 to about 83, deposited on the inner surface of the cathode tube, or the sleeve may be a foil liner of tungsten or tantalum. The screen is woven of metal wire on which is deposited a heavy metal.

4 Claims, 5 Drawing Figures

ETHYLENE QUENCHED MULTI-CATHODE GEIGER-MUELLER TUBE WITH SLEEVE-AND-SCREEN CATHODE

BACKGROUND OF THE INVENTION

Gas-filled radiation detectors have been used for many years to provide qualitative and quantitative information concerning nuclear radiation. Such a detector consists of a hollow cathode defining a gas-filled chamber, and an anode within the chamber electrically insulated from the cathode. A voltage is applied between the anode and cathode. When the detector is placed in a radiation field, nuclear particles enter the chamber, causing ionization and the release of electrons. The ions and electrons are collected and characterized as to energy, type, numbers, etc. The results are typically viewed on an oscilloscope and are recorded and analyzed.

One type of detector is a Geiger-Mueller detector ("GM tube") also referred to as a "counter." A GM tube is characteristically operated in a high voltage range from about 500 volts to about 2000 volts, thereby producing a large output signal which is independent of the nature of the initial ionizing event. Because of its potentially extreme sensitivity, a GM tube can be used to detect even very low levels of all types of nuclear particles including beta, gamma and X-rays. It is in relation to the construction of highly reliable, stable and extremely sensitive GM tubes that this invention is specifically concerned.

Sensitive GM tubes are presently used for a variety of purposes in research, medicine and industry. Among the varied uses are: detecting nuclear radiation and recording the type of particles emitted; measuring the change in radioactivity of bombarded materials; measuring and recording cosmic radiation; detecting and tracing radioactive substances in biological systems; using artificially activated substances to follow the progress of chemical and mechanical changes; and locating oil bearing strata in 'well logging'. GM tubes are expected to perform reliably even under prolonged harsh conditions incident to their use in such devices as oil level detectors or gauges on aircraft where, during service, the GM tubes are subject to severe vibration and widely fluctuating temperatures, pressures and altitudes. Furthermore, since each tube is used repeatedly, it is important that the operating characteristics of the tube, and particularly its starting voltage, be substantially unaffected by repeated use.

The chamber of a GM tube is filled with a monatomic and/or a diatomic gas which becomes ionized by radiation. Typically a noble gas is used which has desirable ionizing characteristics for the particular type of radiation to be monitored. Such a noble gas commonly used is neon, and to a lesser extent, argon. A quench gas is generally used, in addition to the noble gas in the chamber, to prevent the occurrence of unwanted secondary ionization caused by the release of electrons from the cathode, since a noble gas by itself, does not prevent such occurrence. The quench gas has a lower ionization potential than the noble gas and dissociates to dissipate the excitation energy after pulsing.

Over the years, several quench gases have been used including organic compounds such as ethyl alcohol, ethyl formate and methane, and inorganic halogen gases such as bromine and chlorine. The use of bromine is particularly advantageous because its recombination rate after dissociation is nearly 100%, but because of bromine's relatively high mass, a GM tube containing Br does not have a sufficiently short "dead time" to register count rates in the range from about 1000–1500 counts/sec with accuracy. By "dead time" I refer to the recovery period of the tube after it has registered a discharge, during which period the tube may not be used for making a reading of another discharge. However, the temperature stability and longevity of bromine quenched tubes are outstanding, so that such tubes can be used continuously at temperatures of about 300° C., especially if the cathode is plated with chromium or lined with a tungsten foil liner or sleeve as disclosed in copending patent application Ser. No. 182,375 now U.S. Pat. No. 4,359,661.

It is generally known however, that a halogen quench has two disadvantages. First the negative ion effect is present, as evidenced by a steeper rise to a plateau (in a plot of count rate versus voltage), and a longer rise time of the pulse. Second, because of chemical attack of the cathode, a halogen quench necessitates special procedures, as for example, those described in U.S. Pat. No. 3,892,990 to N. Mitrofanov. For the foregoing reasons, and because bromine has a relatively high electron capture cross section, bromine is not the most desirable quench gas in some applications.

It is with GM tubes having relatively high "useful or relative sensitivity" (or simply "sensitivity") to a low level of ionization, that this invention is particularly concerned. "Sensitivity" is a long-recognized measure of the desirability of a GM tube in situations where the number of events likely to be registered within the tube is small, that is, in the range from about 20 to about 200 counts per second (cts/sec). Sensitivity depends upon the product of (a) the efficiency of production of secondary electrons in the counter by the incident radiation, and (b) the efficiency of the tube counter in discharging once for each such secondary electron formed within its sensitive volume (see Increased Gamma-Ray Sensitivity of Tube Counters and the Measurement of Thorium Content of Ordinary Materials by Robley D. Evans, and Raymond A. Mugele (see Review of Scientific Instruments, 7, 441 et seq (1936). In practice, the measure of sensitivity is the ratio: (number of counts)/(number of gamma quants which reach the surface of the tube), and this ratio is usually represented by (N/n).

Thus, though it is generally accepted that hydrocarbons as a class, almost without exception, have the property of 'quenching', and almost any hydrocarbon can be used as a quenching additive, there is nothing to suggest which hydrocarbon might provide sufficiently good quenching particularly in comparison to a halogen quench, and, therefore, sensitivity and stability to allow the reliable measurement of a count rate of from 20–500 cts/sec. (see "Geiger Counters-Theory and Operation" by Serge Korff, Office of Civil Defense Contract No. GEHC 2068 CO 137, New York University, April 1970). Nor is there any reason to expect that $C_2H_4$, alone among the hydrocarbons known to be useful as quenches, would give superior temperature stability and sufficiently short a "dead time" to allow count rates even in the range from about 1000–1500 cts/sec. The design and construction of successful specialty gas tubes is still very much an empirical art.

Since the effect of gas composition on sensitivity and stability of a GM tube does not lend itself to logical deduction, a great number of gas compositions has been tested. For example, ethylene has been used at concentrations greater than 5 percent by volume (% by vol) in conjunction with (a) argon and helium-3 ($He^3$), and (b) with $He^3$ alone, as disclosed in "Extraction of Tritium from Helium-3" by Elliott, M. J. W., Rev. Sci. Inst., 31, No. 11, pgs 1218–1222, at 1221 (1960). But the effect of ethylene as a quench gas cannot be deduced from this disclosure, and in fact, at a pressure within the tube of from about 100 mm to about 400 mm mercury (Hg), the concentration of 5% ethylene is too high to be beneficial in the voltage range from about 1000 to about 1500 volts which is required for practical operation of GM tubes.

Apart from the choice of quench gas, and assuming optimum conditions of pressure and voltage are found at which conditions a GM tube has best sensitivity, such sensitivity is known to be enhanced by increasing the effective area of the cathode by employing metal wire screen cathodes or grooved tube cathodes in place of solid smooth cathodes, and by using metal cathodes of high atomic number. Though the increased cathode area due to the use of a screen is primarily responsible for improved sensitivity of a GM tube, there is a well-defined limit as to how much screen can physically be accomodated within a GM tube before there is "arcing over" between the screen and the anode. This is especially critical because the outside diameter of a GM tube is limited by considerations of space, as in the instance where the tube is used for 'well logging'; and, of course, the diameter is limited by available voltage for operation of the tube. The optimum amount of plated screen, its surface area and mesh size, are determined by trial and error so as to strike the proper balance between increased surface area which improves sensitivity and the shielding effect which decreases it. The problem still to be solved may be stated with the question: Having struck an appropriate such balance within a GM tube, what further, if anything, can be done to improve its sensitivity?

Thus, metallic screens have been coated with certain heavy metals, that is, metals having high atomic numbers, such as bismuth (Bi) or lead (Pb) and have been used in conjunction with brass cathode tubes. Instead of a plated screen, a single tungsten foil liner or sleeve is known to improve sensitivity, particularly when the foil liner is inserted into a stainless steel cathode of a halogen-quenched GM tube, as disclosed in copending application Ser. No. 182,375, now U.S. Pat. No. 4,359,661 the disclosure of which is incorporated by reference thereto as if fully set forth herein. However, the sensitivity due to such a foil liner in a GM tube cannot be improved upon significantly by adding a second tubular foil liner in electrical contact with the tungsten foil liner based upon an expectation that some improvement in sensitivity would derive from the higher absorption provided by the combined liners. Tests indicate that a 2 mil tungsten foil cathode liner actually reduces sensitivity for low energy gamma rays below 0.1 Mev, and there is no significant improvement in sensitivity irrespective of the type of heavy metal from which the foil liner is fabricated, or if an additional foil liner of any heavy metal is added. It is now clear from experimental evidence that a 1 mil thickness of foil liner is the maximum thickness which is preferably used for energy levels in the range from about 120 keV to about 1250 keV, since a greater thickness than 1 mil, even if such greater thickness is derived by plating a deposit of heavy metal on the interior surface of the outer cathode, serves only to reduce sensitivity in the stated energy range. In certain special circumstances where very high energy levels are expected, the thickness of the foil liner may be up to about 2 mil thick, but energy levels in excess of 1 Mev are of little concern in GM tubes of this invention. Since a foil liner and a plated deposit of heavy metal on the inner surface of a cathode, has each been discovered to provide an equivalent function of improvement in sensitivity, though effective thickness is increased in a different manner, they are each referred to in this specification as a "sleeve".

Though a single cathode liner, whether screen or sleeve, has each been used in the prior art, there is nothing to suggest that a combination of screen and sleeve cathodes, such as a dual-sleeve cathode, might have any desirable effect on sensitivity or stability, much less that such desirable properties as each may have been evaluated individually, might actually be improved. Considering that any evaluation of the probable effects of "ganging up" liners is reasonably to be made relative to a particular range of energy levels in which the GM tubes are to be operated, it appeared that increasing the effective thickness of liners for tubes to be operated in the range from 122 keV to about 1250 keV, was contraindicated.

It is known that as the thickness of material exposed to the gamma radiation is increased, scattering will obscure the initial direction of emission of electrons, and in a thick foil of high Z material, effective emission will be isotropic for all processes; also, that whatever the material of the foil, the maximum electron production will occur for a foil of thickness equal to the range of the photooelectron. (see "Nuclear Radiation Detectors", by Jack Sharpe, pg 91 et seq., Methuen & Co. Ltd., London (1964). The identity of the particular metals through which the photoelectron travels is surprisingly unimportant, the range in lead being only about 25 percent less than that in aluminum, stated in $mg/cm^2$. For gamma rays in the range from about 122 keV to about 1250 keV, the range of the photoelectron in a heavy metal is calculated to be less than 20 $mg/cm^2$, recognizing this is inapplicable in the Compton range. Therefore, it would be expected that any increase in effective thickness of material greater than 20 $mg/cm^2$ would decrease sensitivity, particularly as the coating of heavy metal is on wire which itself is at least 10 mil thick, or it would be difficult to weave the wire into a screen.

Since, from a theoretical point of view, effective thickness of the liner directly confronts gamma radiation to which the GM tube is exposed, it appeared equally improbable that ganging up a sleeve with a screen which already has a heavy metal coating of at least 15 $mg/cm^2$ of screen surface (equivalent to 0.285 mil thickness of metal), to provide a greater net effective thickness than 0.375 mil, would provide an increase in either sensitivity of the tube, or its stability. A thickness of 0.375 mil is produced by plating about 18 $gm/cm^2$. It would therefor be expected that a cathode plated with in excess of 18 $gm/cm^2$ of a heavy metal would exhibit decreased sensitivity. It does not. Moreover, by inserting a screen, plated with a heavy metal, into the plated cathode tube, or into the foil liner inside the cathode tube, one would expect a further decrease in sensitivity because of the increase in net effective thickness of heavy metal. It does not.

In view of the foregoing it was especially unexpected that the addition of a screen liner, in addition to a sleeve, (whether the foil liner or the plated deposit), should be a desirable combination for measuring gammas in the range from about 122 keV to about 0.67 Mev. In the GM tubes of this invention, quite unexpectedly, such a combination is.

SUMMARY OF THE INVENTION

It has been discovered that a Geiger-Mueller detector ("GM tube") containing a gaseous mixture consisting essentially of neon and from 0.1% by vol to 2% by vol of argon (this mixture hereafter referred to as "noble gas"), and, a small but critical amount of ethylene ($C_2H_4$) in the range from 2% by vol but less than 5% by vol as the quench gas, provides excellent stability in the temperature range from about 20° C. to about 200° C., and a pressure in the range from about 100 mm to about 400 mm Hg.

Accordingly it is a general object of this invention to provide a GM tube filled with noble gas containing from 2% by vol but less than 5% by vol of ethylene, at a total pressure within the tube of from about 100 mm to 400 mm Hg which tube will operate in the voltage range from about 1000 to about 1500 volts.

It has also been discovered that a relatively small diameter multi-cathode GM tube comprising a solid smooth metal outer cathode in combination with a sleeve-and-screen cathode (also referred to as a "dual-liner" cathode insert) telescoped within the outer cathode, is more sensitive at gamma ray energy levels in the range from above about 122 keV but below about 1250 keV, than the same outer cathode with a single liner in it, whether the single liner is a plated screen, or a foil sleeve of heavy metal, or an electrodeposited coating of heavy metal on the inner surface of the outer cathode.

Accordingly, it is a specific object of this invention to provide a multi-cathode GM tube comprising a solid smooth metal outer cathode in combination with a sleeve-and-screen cathode telescoped within the cathode, the screen-and-sleeve cathode comprising (a) a sleeve of smooth heavy metal in electrical contact with the outer cathode, and, (b) a screen of metal wire in the size range from about 6 mesh to about 80 mesh U.S. Standard Screen Scale, which screen is plated with a heavy metal and is in electrical contact with the surface of the sleeve. By 'heavy metal' is meant a 'high Z' metal having an atomic number in the range from 73 to 83, it being recognized that not all heavy metals may be plated on a screen, and not all heavy metals may be formed into a foil liner, or, electrodeposited onto the inner surface of the cathode.

It has still further been discovered that the combination of the multi-cathode described hereinabove with noble gas containing ethylene as quench gas, provides a GM tube of excellent sensitivity and stability, the operating characteristics of which may be tailored by the choice of the heavy metals used for the sleeve, and for the screen, of the screen-and-sleeve cathode insert.

It is therefore another specific object of this invention to provide an unexpectedly effective construction of a highly sensitive GM tube of remarkable stability and quick recovery ("low dead time") using noble gas with a small but critical amount of ethylene as a quench gas, and, a multi-cathode including a sleeve-and-screen cathode insert, which construction obviates the necessity of passivation or thermal cycling because of the use of ethylene instead of a halogen. Such a GM tube is especially desirable for 'well logging' applications where it is essential that the tube have a length to diameter ratio in the range from about 8 to about 20, and be operable with a voltage in the range from about 1000 to 1500 volts.

BRIEF DESCRIPTION OF THE DRAWINGS

The foregoing and other objects and advantages of my invention will appear more fully from the following description, made in connection with the accompanying drawings, of a preferred embodiment of the invention, wherein the reference characters, if duplicated, refer to the same or similar parts, and in which.

DETAILED DESCRIPTION OF PREFERRED EMBODIMENTS

Figure 1:
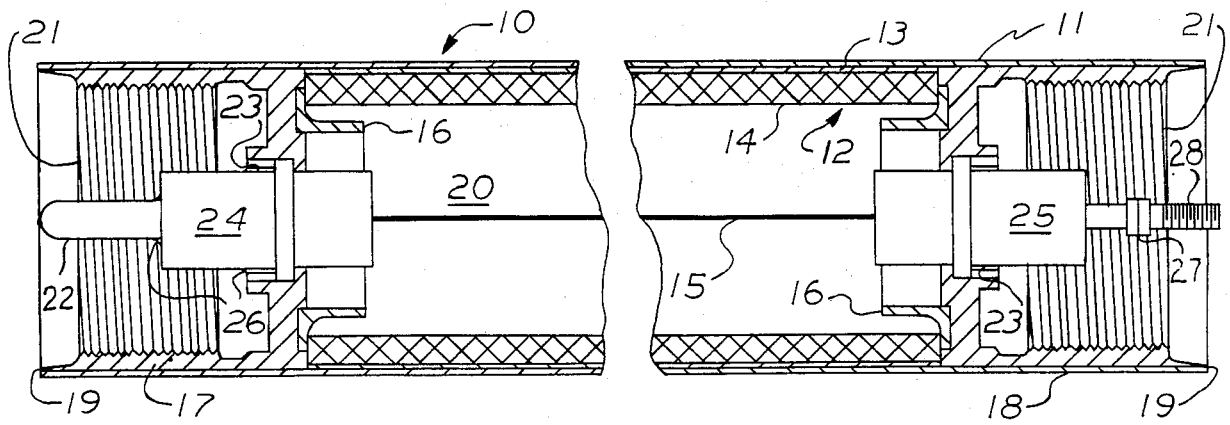
FIG. 1 is a side elevational view, partially in cross-section and with the intermediate portion of the Geiger-Mueller tube of this invention broken away, schematically illustrating the essential structural features of its construction.

A GM tube of this invention, containing 'noble gas' and using ethylene as the quench gas, is believed to owe its better stability than that obtained with other hydrocarbons, due to the quenching of ions by the peculiar dissociation of ethylene into fragments. Ethylene behaves differently as a quench gas from other monoolefins, even propylene, because of the size and type of fragments formed upon dissociation in the particular noble gas mixture used which mixture is referred to herein as 'noble gas' for brevity. This 'noble gas' used in this invention consists essentially of from about 98 to about 99.9% by vol of neon (Ne) and from about 2 to about 0.1% by vol of argon (Ar). As is well known, Ne has too many metastable excited states, and the deliberate addition of the A decreases the slope, and, increases the length of the plateau of a curve generated by plotting count rate against applied voltage. However, knowing this, the additional effect of the additional presence of another gas in such a Ne-Ar noble gas is not predictable. Apparently because of the peculiar characteristics of ethylene fragments formed, ethylene also behaves differently from alkanes starting with methane and ethane; from alcohols, particularly monohydric aliphatic primary alcohols starting with methyl alcohol and ethyl alcohol; and, from alkyl esters of such alcohols, starting with lower alkyl esters such as methyl formate and methyl acetate.

The stability of an ethylene quenched GM tube, to be operated in the voltage range from about 1000 to about 1500 volts, is especially high when the ethylene is present in a small but critical amount in the range from 2% by vol but less than 5% by vol, all other factors being the same. Such stability is of especial significance when the GM tube is to be operated at relatively high temperatures in the range from about 25° C. to about 200° C.

Though the use of the specific noble gas with an ethylene quench provides sufficient sensitivity and stability for some purposes, it is insufficient for particular applications such as in 'well logging'. In this application the tube is exposed to natural background radiation inside the earth due to thorium, uranium and other radioactive materials including their decay products which are dispersed in varying degrees of uniformity in basalt, granite and other geological strata. Since well logging is a desirable application of great commercial significance, a particularly preferred embodiment of this invention comprises an ethylene-quenched GM tube which is especially constructed to provide excellent sensitivity and operating characteristics for well logging. This sensitivity is predicated upon the use of a multi-cathode including a dual-sleeve cathode in contact with the noble gas containing ethylene.

This particular GM tube for well logging applications uses a conventional cylindrical smooth solid tubular outer cathode made of an electrically conductive metal, e.g. a ferrous or nickel alloy such as stainless steel, or a copper alloy such as brass, and is formed from a sheet thick enough not to collapse the cathode when it is evacuated. Typically the sheet has a thickness in the range from about 10 mils to about 35 mils, depending upon the overall size of the GM tube being constructed. Since for well logging applications the outside diameter of a GM tube is usually in the range from about 1.75 cm to about 5 cm, and its active length ranges from about 1.75 cm to about 60 cm, it will be seen that these GM tubes have the imposed limitation, by virtue of the size of an exploratory well being bored, of having a ratio of length to diameter in the range from about 8 to about 20. By "active length" is meant the length of a chamber within the cathode between the wall thereof and end caps which seal the chamber, as is explained in greater detail hereinbelow.

Against the interior surface of the outer cathode and in electrical contact therewith, is placed a sleeve-and-screen cathode, also referred to as a 'sleeve and screen liner'. The sleeve-and-screen cathode comprises (a) a tubular sleeve of smooth metal foil selected from a heavy metal of the group consisting of tantalum, tungsten, rhenium, osmium, iridium, platinium, gold, mercury, lead, bismuth, and metallic alloys or amalgams thereof, and, deposited metal coatings thereof, in electrical contact with the outer cathode which has a relatively larger exterior surface than that of the sleeve; and, (b) a screen of woven metal wire in electrical contact with the tubular sleeve, which screen is coated with a heavy metal.

The sleeve may be electrodeposited, or otherwise deposited as a continuous metal layer from about 0.25 mil to 1 mil thick by any known method, which layer will contain approximately 10 mg/cm$^2$ to about 50 mg/cm$^2$ of heavy metal on the inner surface of the cathode. As an alternative, the sleeve may be formed from tubular metal foil having a thickness in the range from about 0.5 mil to 1 mil thick. The term 'sleeve' is used herein to refer to either a deposited layer or a tubular foil of heavy metal, and to distinguish each from a "screen" of woven metal wire which is typically coated with bismuth or lead. The screen is an essential part of the dual-sleeved cathode of this invention.

The metal wire screen is generally formed as a cylindrical roll from brass, bronze, copper, nickel, cobalt, zinc, or stainless steel, and necessarily is coated, preferably by electrodeposition, with a small but significant amount of a heavy metal sufficient to increase the absorption of gamma radiation by the coated screen by at least 10 percent.

The term 'smooth solid tubular metal foil' is used to distinguish the physical form of a tubular foil cathode sleeve from a sleeve of heavy metal deposited on the inner surface of the outer cathode. The metal wire screen which has through-openings, is also an essential component of the multi-cathode of the GM tube of this invention. The tubular heavy metal foil sleeve, the sleeve or layer of deposited heavy metal, and, the screen, are all generally referred to herein as "liners" because they line the interior of the outer cathode. The heavy metal sleeve and the screen liner may each be formed from different metals, or, of the same metal, e.g. platinum, but a dual-liner of platinum is presently uneconomical in a commercial GM tube for well logging.

Referring now more specifically to the drawings, and in particular to FIG. 1, there is schematically illustrated in broken away partial cross section, the ethylene quenched GM tube of this invention referred to generally by reference numeral 10, including a multi-cathode which comprises a tubular cylindrical stainless steel outer cathode 11 the inner surface of which is lined with a sleeve-and-screen cathode, referred to generally by reference numeral 12. This sleeve-and-screen cathode 12 in the most preferred embodiment shown herein, comprises in combination, (a) a sleeve 13 of electrodeposited heavy metal, or a smooth solid heavy metal tubular foil in electrical contact with the outer cathode 11, and (b) a roll 14 of at least one layer of plated metal wire screen in electrical contact with the tubular foil.

The cathode 11 may be fabricated from any metal conventionally used for GM tubes. Typically metals such as brass and bronze are preferred, but 304 stainless steel is one of several stainless steels more preferred for the GM tube of this invention.

The tubular foil sleeve 13 is preferably formed from tungsten or other heavy metals which are characterized by a 'high Z absorption' such as tantalum, tungsten, osmium, iridium, platinum, gold and lead. Tantalum and tungsten are most preferred. The metal screen liner is most preferably formed from commercially available woven screens which have been electroplated by any known means with a heavy metal selected from rhenium, iridium, platinum, gold, lead and bismuth. Alternatively, an amalgam of Hg may be formed on the surface of the wire from which the screen is woven, or an alloy of two or more of the foregoing heavy metals may be electrodeposited on the screen. If sleeve 13 is electroplated, Bi is most preferred, and it is deposited in the range from about 15–30 mg/cm$^2$.

A stainless steel cylindrical outer cathode 11 has inserted therewithin the sleeve 13, for example, of tungsten, which is formed by cutting a strip of the metal foil 1 mil thick, having a length corresponding substantially to that of the chamber 20, a width which corresponds closely to the circumference of the inner surface of cathode tube 11. When the strip is inserted into the cathode tube, because of the strip's stiffness due to its high spring constant, the strip lies in contact with essentially the entire inner surface of the outer cathode tube 11.

The roll of screen 14 is typically formed from bismuth plated brass or nickel wire screen, preferably having a mesh size in the range from about 6 mesh to about 140 mesh, most preferably 30–100 mesh, U.S. Standard Screen Scale. The screen roll is preferably spot-welded along its length to form a single or double-layered screen roll, depending upon mesh size, and the diameter of the screen roll is so chosen that when it is inserted into the tube 11 the screen roll lies within and in electrical contact with the tubular foil sleeve 13. For practical reasons, such as clogging the screen openings with heavy metal deposited on the wire, and unnecessarily using more wire than is economical, screens finer than 140 mesh are not preferred. For structural reasons, it is best to use screens woven from nickel or brass wire having a diameter in the range from about 16 mils to about 0.052 in., and most preferably from about 0.016" to 0.0315". The tubular foil sleeve 13 and the screen roll 14 are held concentrically diposed within tube 11 by copper adaptors 16.

As is further illustrated in FIG. 1, the left end (as viewed therein) of the cathode tube 11 is sealed off with a cup-shaped end cap 17 fabricated from a metal such as 446 stainless steel and welded along the rim at 19 to the cathode tube 11 by, for example, heliarc welding. The end cap 17 is provided with internal screw threads 21 for mounting on a support means (not shown), and with a central axial stepped bore 23 through which a ceramic collar 24 is inserted and sealed in with hot liquid glass (also referred to as 'solder glass') 26. In an analogous manner, another ceramic collar 25 is glassed into right end cap 18, also provided with internal screw threads 21, so that a fluid tight seal is formed. The coefficient of expansion of the solder glass closely approximately that of both the ceramic collar and stainless steel cap in order to prevent cracking during thermal cycling. The interior wall of cathode tube 11 and the end caps 17 and 18 define an ion chamber 20 which may be filled through glass tube 22 at one end thereof, with noble gas containing ethylene.

A wire anode 15 is longitudinally axially disposed within the sleeve-and-screen cathode 12, and one end of the wire anode is anchored in left ceramic collar 24 so that glass tube 22 is in open fluid communication with chamber 20. At the right end of the GM tube, a threaded coupling nut 27 is provided on a threaded stainless steel terminal 28 axially embedded in ceramic collar 25, through which terminal the chamber 20 is electrically connected to a suitable radiation counting and measuring system, and, a source of high voltage neither of which are shown.

The assembly of foregoing components is sealed to a glass manifold of a vacuum station and heated under high vacuum at a temperature in the range from about 350°–500° F. After purging and 3–4 hours of heating, the assembly is cooled down and filled with the noble gas containing 3.5% by vol ethylene. These details concerning construction of the GM tube (except for adding ethylene) are well-known and do not comprise part of the present invention. Though the ethylene-containing noble gas for the GM tube of this invention is novel, the tube itself is constructed and filled with this gas mixture ("fill-gas") in a conventional manner. The amount of fill-gas used is controlled so that the pressure within chamber 11 is in the range from about 100–400 mm Hg and preferably in the range from about 200–300 mm Hg.

The ethylene-quenched GM tube of this invention is thought to owe its excellent stability and sensitivity due to a combination of several factors which combination is unique for a GM tube filled with noble gas and quenched with from 2–5% by vol ethylene. Ethylene fragments generated in the ion chamber do not polymerize on the anode or on the surfaces of the cathode sufficiently to affect the continued operating characteristics of the tube.

Further, with noble gas instead of either pure neon or pure argon, an ethylene quench provides a long plateau in a curve of count rate versus operating voltage.

Still further, noble gas quenched with ethylene provides stability over the relatively broad range from just above the condensation temperature of ethylene (about −103° C.) up to about 200° C. if operation at the upper temperature is not for an extended period of time. In the temperature range from about 20° C. to about 175° C., the GM tube of this invention may be operated more reliably over periods of 60 hours or more, with better results than any other organic-quenched tube we know of.

Moreover, unlike with other organic quenched GM tubes in which the starting voltage increases after use of the tubes, in our GM tube, the starting voltage actually decreases after using it, which is as highly desirable a characteristic as it is unexpected.

Finally, the remarkably low dead time in the range from about 65 microseconds for a 0.75 inch diameter tube, to about 150 microseconds for a larger tube, permits high number of readings at high count rates with low energy radiation, particularly in the range from about 0.3 to about 0.5 MeV, such as is typically encountered in well logging.

To determine the effect of combining a cylindrical tubular screen inserted within a tubular outer cathode containing a tubular sleeve 1 mil W foil snugly fitted against the inner wall of the outer cathode, the following experiments were conducted:

Three tubes were constructed. One contained an incrementally plated (along its longitudinal axis) brass screen formed as a double-layered screen roll, and not sleeve. Another tube contained a 1 mil W foil sleeve but no screen. The third contained a screen plated with 20 mg/cm$^2$ of Bi, and a 1 mil W foil liner.

The incrementally plated screen was prepared by taking a rectangular section of brass 60 mesh screen (U.S. Standard Sieve Scale) 11" (inches) long and 1" wide, woven from 30 mil wire, and completely immersing it lengthwise in a plating solution with a fixed current of six amperes to plate bismuth onto the immersed screen. Every fifteen minutes the screen was raised from the solution by one inch. Therefore, the first segment to be removed from the plating solution had one unit of deposited bismuth, the second segment, two units, et seq., for a combined total of 65 units on all eleven segments. The total weight deposited during the plating procedure (17.87 g) divided by the total number of plating units (65) permits the determination of the plating depth on each 1"×1" position of the screen.

The amount of deposited bismuth per 'unit' = 17.87/65 = 0.275

The surface area of screen is 66 cm$^2$/in$^2$ of screen. Thus, the first portion removed form the plating bath has 4.2 mg/cm$^2$ Bi deposited on it, the second portion removed has 8.3 mg/cm$^2$ deposited on it, et seq., until the last (eleventh) has 41.6 mg/cm$^2$ deposited on it.

A strip incrementally plated as described hereinabove was inserted within each cathode to be tested with sources having varying radiation energy levels. All tubes were filled with noble gas mixture and also included about 3% by volume ethylene as the quech gas.

A test fixture was constructed from lead bricks and wood boards so as to allow a tube inserted in the fixture to be moved vertically axially directly in front of a 0.25 $in^2$ gap in the bricks without changing the geometrical relationship of the tube to the source of radiation being used. Appropriate electronics, including a preamp, counter-scaler combination, and quench resistor are used to make measurements of sensitivity.

The following sources are used for the experiments:

| | | | |
|---|---|---|---|
| HC 726 | Cobalt 57 | 24.3 uci | 122 kev |
| HC 246 | Barium 133 | 3.8 uci | 356 kev |
| HC 244 | Cesium 137 | 7.0 uci | 662 kev |
| HC 260 | Cobalt 60 | 2.7 uci | 1250 kev |

With the source in place and a bias of 1050 volts applied to the tube containing the incrementally plated screen, a series of five minute counts were made covering each one inch segment and the difference in relative count rate plotted as shown in FIGS. 2–5.

After these measurements were completed, a count rate corrected for background radiation, was taken for each tube lined only with the 1 mil tungsten liner; and again, for each tube lined with both the 1 mil tungsten liner and a screen which is uniformly plated with 20 $mg/cm^2$ of Bi.

Figure 2:
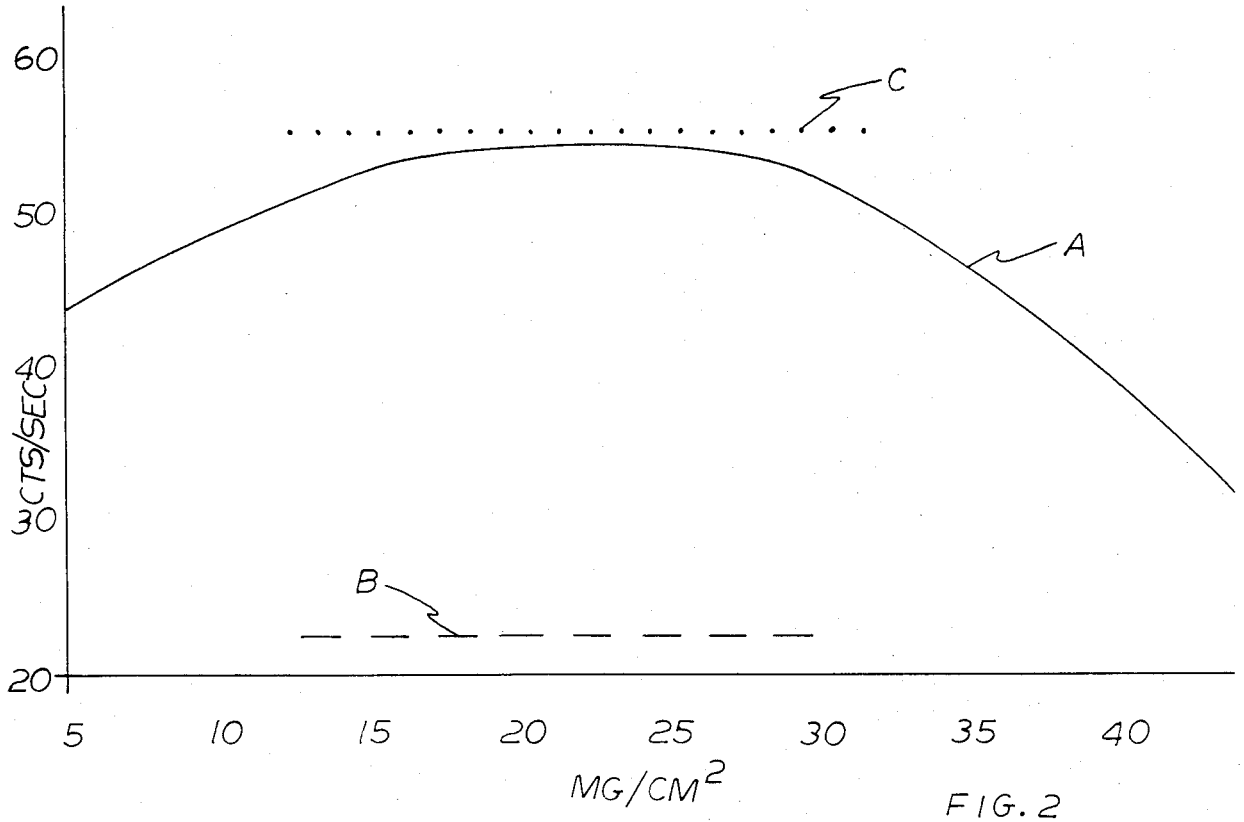
FIGS. 2-5 are plots of sensitivity (counts/second) against varying thicknesses of electrodeposited bismuth (given as mg of Bi/cm$^2$ of screen area) on identical portions of brass 80 mesh screen, in which plots (identified by reference symbol A) are shown test results utilizing 122 keV, 356 keV, 662 keV, and 1250 keV gamma ray sources of $Co^{57}$, $Ba^{133}$, $Cs^{137}$, and $Co_{60}$ respectively; also known in each plot is the sensitivity obtained with a 1 mil tungsten liner only (shown as a dashed line) indicated by reference symbol B; and, the sensitivity obtained with a combination of the 1 mil tungsten liner with a 80 mesh brass screen plated with 20 mg of Bi/cm$^2$ of screen area, (shown as the dotted line) indicated by reference symbol C.

Referring particularly now to each of the graphs plotted in FIGS. 2–5:

FIG. 2 is a plot (identified by reference symbol A) of sensitivity (counts/second) against varying thicknesses of electrodeposited bismuth (given as mg of $Bi/cm^2$ of screen area) on a brass 80 mesh screen utilizing a 122 kev gamma ray source of $Co^{57}$; also shown is the sensitivity obtained with a 1 mil tungsten (W) liner only (shown as a dashed line) indicated by reference symbol B; and, the sensitivity obtained with the combination of the 1 mil W liner with a brass screen coated with 20 mg of $Bi/cm^2$ of screen, (shown as the dotted line) indicated by reference symbol C.

It is seen that the multi-cathode tube (double lined) and the tube with only the incrementally plated screen at a plating depth corresponding to 22 $mg/cm^2$ show a nearly equivalent sensitivity (response). The tube with only the 1 mil W liner is less than half as sensitive (41%) as either the screen-and-sleeve lined tube, or the screen-lined tube.

Figure 3:
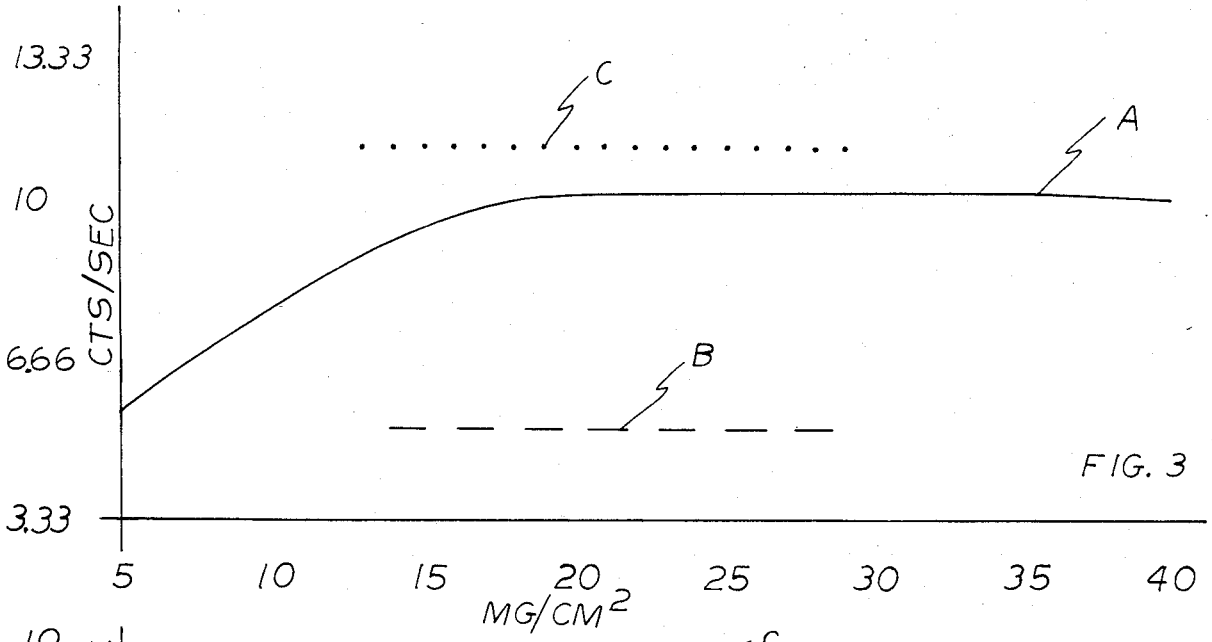

FIG. 3 is a plot (identified by reference symbol A) of sensitivity (cts/sec) against varying thicknesses of electrodeposited bismuth plated on an identical portion of brass 80 mesh screen as used hereinbefore for the test results recorded in FIG. 2, utilizing a 356 kev gamma ray source of $Ba^{133}$; also shown is the sensitivity obtained with a 1 mil W liner only (shown as a dashed line) indicated by reference symbol B; and, the sensitivity obtained with the combination of the 1 mil W liner with a brass screen coated with 20 mg of $Bi/cm^2$ of screen area, (shown as the dotted line) indicated by reference symbol C.

The tube with only a 1 mil W liner is 49% as sensitive as the tube with the incrementally plated screen at 22 $mg/cm^2$. The screen-and-sleeve tube is 10% more sensitive than the screen-lined tube.

Figure 4:
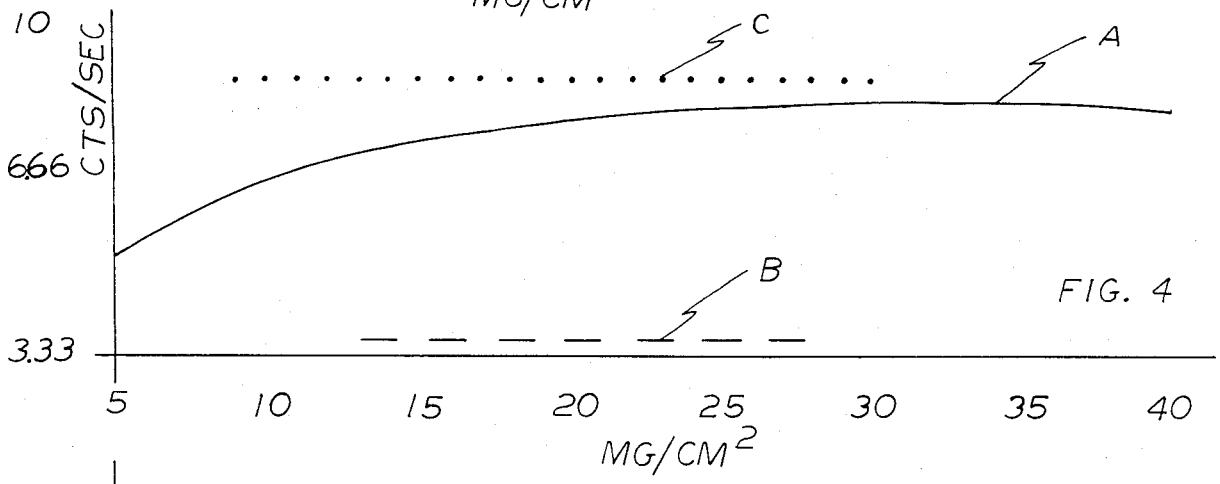

FIG. 4 is a plot (identified by reference symbol A) of sensitivity (cts/sec) against varying thickness of electrodeposited bismuth plated on an identical portion of brass 80 mesh screen as used for the test results recorded in FIG. 2, utilizing a 662 kev gamma ray source of $Cs^{137}$; also shown is the sensitivity obtained with a 1 mil W liner only (shown as a dashed line) indicated by reference symbol B; and, the sensitivity obtained with the combination of the 1 mil W liner with a brass screen coated with 20 mg of $Bi/cm^2$ of screen area, (shown as the dotted line) indicated by reference symbol C.

The tube with only the 1 mil W liner is 48% as sensitive as the tube with the incrementally plated screen at 22 $mg/cm^2$. The screen-and-sleeve lined tube is 26% more sensitive than the screen-lined (only) tube.

Figure 5:
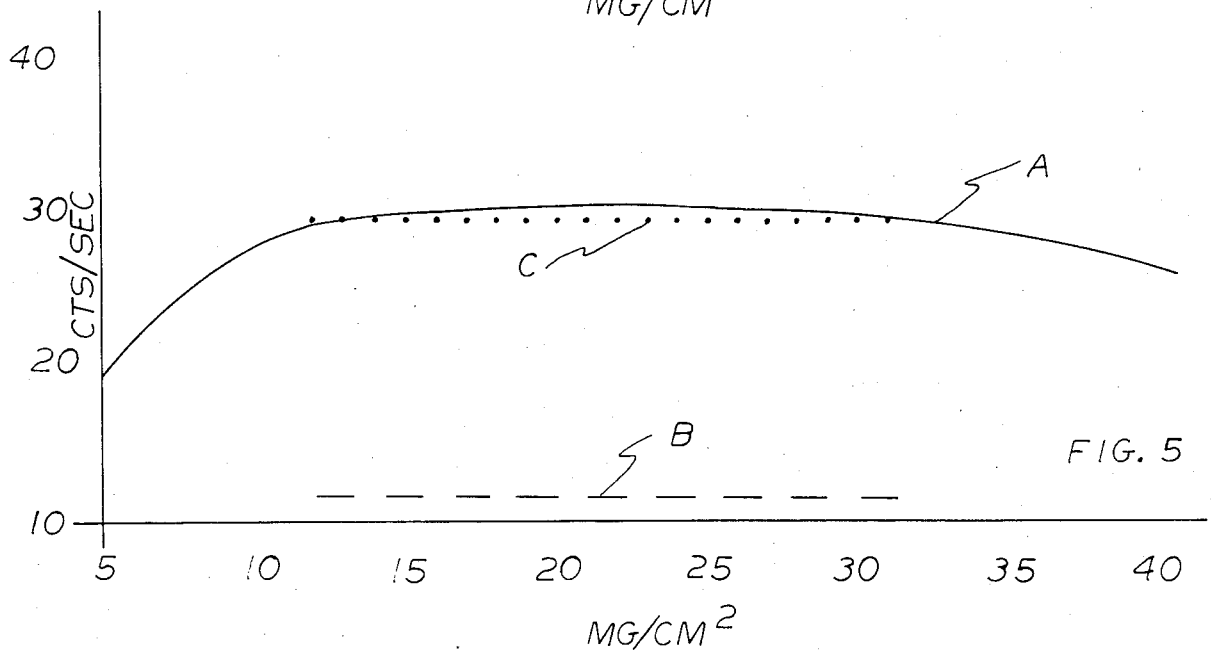

FIG. 5 is a plot (identified by reference symbol A) of sensitivity (cts/sec) against varying thicknesses of electrodeposited bismuth plated on an identical portion of brass 80 mesh screen as used for the test results recorded in FIG. 2, utilizing a 1250 kev gamma ray source of $Co^{60}$; also shown is the sensitivity obtained with a 1 mil W liner only (shown as a dashed line) indicated by reference symbol B; and, the sensitivity obtained with the combination of the 1 mil W liner with a brass screen coated with 20 mg of $Bi/cm^2$ of screen area, (shown as the dotted line) indicated by reference symbol C.

The tube with only the 1 mil W liner is 40% as sensitive as the tube with the incrementally plated screen at 22 $mg/cm^2$. The screen-and-sleeve lined tube has essentially the same sensitivity, the additional 1 mil W liner providing essentially no additional sensitivity.

From the foregoing it can be seen that a plating depth corresponding to electrodeposition of a coating of bismuth in the range from about 15–25 $mg/cm^2$ provides increased sensitivity for gamma radiation in the energy range from about 356 keV and just below, to about 662 keV and just above. The screen-and-sleeve lined tube is from 10% to about 25% more sensitive than a tube line only with a plated screen, in the range from 356 keV to about 662 keV.

Even higher sensitivity can be achieved by using a thinner foil liner, say a 0.5 mil W foil, or by plating the cathode on its inner surface with a heavy metal in an amount of from about 15 $mg/cm^2$ of inner surface area, to about 50 $mg/cm^2$, most preferably from 15–20 $mg/cm^2$, so as to correspond to a depth of from about 0.2 to about 0.5 mil of heavy metal thickness. When such a plating is used as the sleeve instead of the foil liner, a substantially lesser thickness than that of the 1 mil foil liner is found to be highly effective.

From the foregoing results it was determined that a brass screen electroplated with about 20 $mg/cm^2$ of Bi increased sensitivity approximately by a factor of 2.5 compared with a bare (uncoated) stainless steel cathode. Insertion of a heavy metal sleeve such as a 1 mil thick W foil between the stainless steel cathode and the Bi-plated screen further increases sensitivity. Having experimentally established this increase in sensitivity as a fact, it may be attributed to the W foil adding photoelectrons which pass through voids in the screen. Comparable, and even higher sensitivities may be obtained with a stainless steel cathode which has been electroplated with a heavy metal so as to form an inner layer (sleeve).

We claim:

1. In a Geiger-Mueller radiation detector including an outer tubular stainless steel cathode, an anode disposed in spaced apart relationship thereto in a sealed chamber walled by said cathode, and a gaseous mixture of noble gas containing a minor amount of a quench gas sealed in said chamber, the improvement comprising a sleeve-and-screen cathode in contact with said gaseous mixture, the sleeve comprising a tungsten layer in electrical contact with said outer tubular cathode, and the screen being in electrical contact with said sleeve and comprising a 6 to 140 size mesh (U.S. Standard Screen) metal selected from the group consisting of brass and nickel, said screen coated with bismuth in an amount in the range from about 15 mg/cm$^2$ to about 30 mg/cm$^2$ of screen surface area.

2. The detector according to claim 1 wherein the screen is coated with bismuth sufficient in amount to increase by at least 10% the capacity of the screen to absorb gamma radiation.

3. The detector according to claim 2 wherein said sleeve consists essentially of a smooth solid tubular foil having a thickness of from about 0.5 mil to about 1 mil.

4. The detector according to claim 1 wherein the ratio of active length of said outer cathode to its diameter is in the range from about 8 to about 20, and said diameter is at least 1.75 cms.

* * * * *